US009060913B2

(12) United States Patent
Hensler

(10) Patent No.: US 9,060,913 B2
(45) Date of Patent: Jun. 23, 2015

(54) SURGICAL TABLE MAGNETIC INSTRUMENT HOLDER

(71) Applicant: H & M Innovations, LLC, Wilmington, NC (US)

(72) Inventor: Robert Sean Hensler, Wilmington, NC (US)

(73) Assignee: H & M INNOVATIONS, LLC, Wilmington, NC (US)

( * ) Notice: Subject to any disclaimer, the term of this patent is extended or adjusted under 35 U.S.C. 154(b) by 0 days.

(21) Appl. No.: 13/842,900

(22) Filed: Mar. 15, 2013

(65) Prior Publication Data

US 2014/0263889 A1 Sep. 18, 2014

(51) Int. Cl.

| | |
|---|---|
| ***A47G 1/17*** | (2006.01) |
| ***A61G 13/10*** | (2006.01) |
| *A61G 13/12* | (2006.01) |
| *A61G 7/05* | (2006.01) |

(52) U.S. Cl.

CPC ..... *A61G 13/101* (2013.01); *A61G 13/1285* (2013.01); *A61G 2007/0518* (2013.01)

(58) Field of Classification Search

CPC ..... A61B 19/0256; A61B 17/06061; A61B 19/26; A61G 13/101

USPC ..... 248/37.3, 37.6, 214, 309.4; 211/70.6, 211/70.7, DIG. 1

See application file for complete search history.

(56) References Cited

U.S. PATENT DOCUMENTS

| | | | | |
|---|---|---|---|---|
| 3,366,230 | A * | 1/1968 | Loran | 206/63.5 |
| 3,483,494 | A | 12/1969 | Cromie | |
| 3,747,655 | A * | 7/1973 | Hadtke | 108/90 |
| 3,776,387 | A | 12/1973 | Brent | |
| 3,868,016 | A * | 2/1975 | Szpur et al. | 206/350 |
| 4,321,999 | A | 3/1982 | Higgins | |
| 5,078,280 | A * | 1/1992 | Nordeen | 211/119.003 |
| 5,170,804 | A * | 12/1992 | Glassman | 128/849 |
| 5,511,674 | A * | 4/1996 | Boyd et al. | 211/70.6 |
| 7,665,606 | B2 * | 2/2010 | Gaillard | 206/363 |
| 2011/0163137 | A1 * | 7/2011 | Podda-Heubach | 224/183 |

* cited by examiner

*Primary Examiner* — Gwendolyn W Baxter

(74) *Attorney, Agent, or Firm* — Tillman Wright, PLLC; Chad D. Tillman; Jeremy C. Doerre

(57) ABSTRACT

A instrument holder is disclosed that is adapted to be attached to a side edge of a surgical table in an operating room and that includes a magnet by which metallic instruments are attachable to the holder for staging during performance of a medical procedure in the operating room. The magnet further may assist in retaining and/or stabilizing the holder in its attachment to the side edge of the table. The holder may include grooves for receiving certain types and/or sizes of instruments. During performance of a medical procedure the holder may be moved to a different side edge of the table. The holder preferably is contained within a plastic, transparent, pliable sleeve for maintaining sterility of the holder, whereby the holder is reusable in subsequent procedures.

20 Claims, 7 Drawing Sheets

Additional Schematic Drawings of the magnetic instrument holder

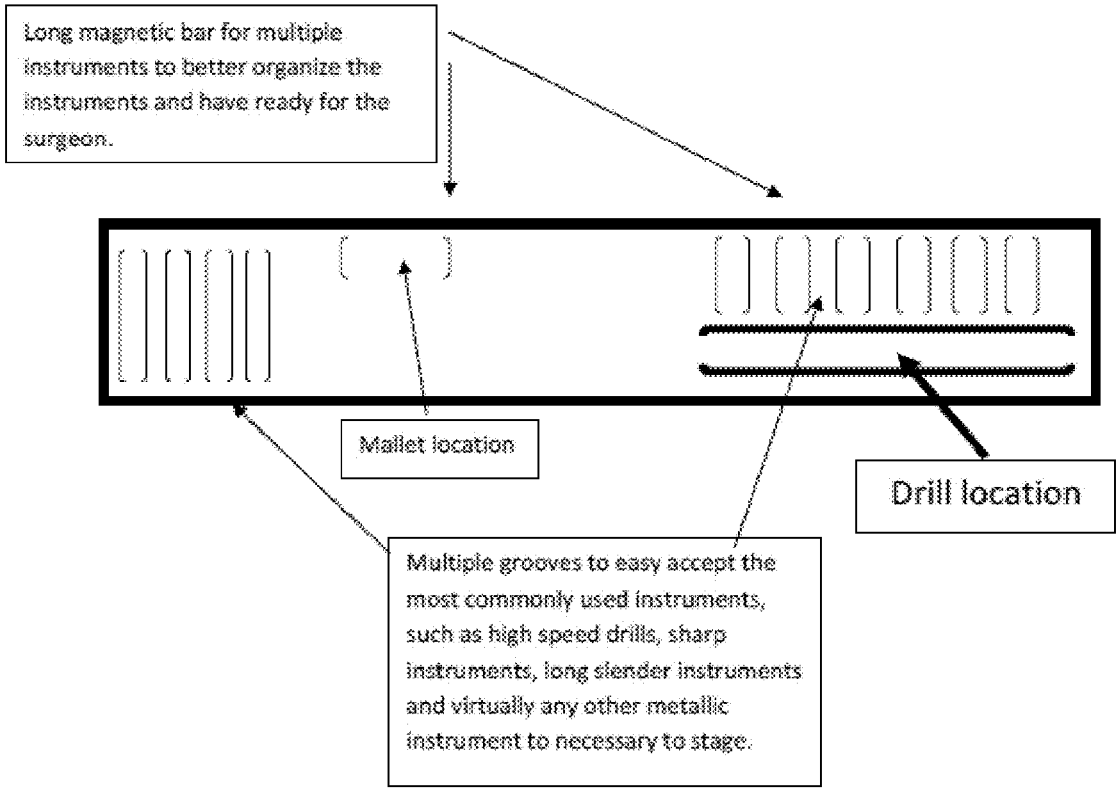

Points of interest for the forward facing aspect of the magnetic instrument holder

- There will be a drill location, common in most surgeries. It will be horizontally configured as shown.
- The logo will be placed in the middle.
- The mallet location will have projections for easy attachment and use.
- The projected size will be 18" wide and 2" high.
- The depth will be ½ inches at the top and 2 ½ inches on the bottom.
- The magnetic instrument holder will be comprised of stainless steel and magnets.

FIG. 7

SURGICAL TABLE MAGNETIC INSTRUMENT HOLDER

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE INVENTION

Within each operating room (OR) suite, there are multiple instruments used by the surgeon and/or assistant. These instruments are commonly dropped, set down rapidly, and not only does a clutter of wires and instruments occur, safety and sterility is challenged. Also in each OR there is a surgical table utilized to store and stage most instruments to be handed to the surgeon and/or assistant. The longest side of this surgical table faces the surgeon and surgical field. This is the long edge of the sterile table where the magnetic bar is to be utilized.

Furthermore, at the beginning of each surgical procedure, staff sets up the instruments on the sterile surgical table. Many of the most common instruments are placed on this table over the patient for immediate use for the surgeon and/or assistant. Common instruments include high speed drills, scalpels and multiple long and slender instruments used repeatedly. Almost all of these instruments used are metallic.

The present invention addresses a perceived need for organizing and presenting such instruments in a quick and efficient manner that is convenient to the surgeon and/or assistant, and in a way that de-clutters the operating room while improving safety and efficiency.

SUMMARY OF THE INVENTION

The present invention generally relates apparatus and methods for holding, organizing, and presenting surgical instruments during a medical procedure in an operating room and the like.

The present invention includes many aspects and features. Moreover, while many aspects and features relate to, and are described in, the context of surgical procedures in in operating room, the present invention is not limited to use only in such context, as will become apparent from the following summaries and detailed descriptions of aspects, features, and one or more embodiments of the present invention.

Accordingly, in one aspect of the present invention, a magnetic instrument holder is adapted to be attached to a side edge of a surgical table in an operating room and comprises a magnet by which metallic instruments are attachable to the holder for staging during performance of a medical procedure in the operating room.

In a feature, the magnet further assists in retaining and/or stabilizing the holder in its attachment to the side edge of an operating table.

In a further feature, the holder includes grooves for receiving certain types and/or sizes of instruments.

In another feature, the holder is configured to enable detachment and reattachment to a different side edge of the surgical table during performance of a medical procedure.

In another feature, the apparatus further comprises a plastic, transparent, pliable sleeve within which the holder is contained for maintaining sterility during a medical procedure, whereby the holder is reusable in subsequent procedures.

Another aspect comprises a magnetic instrument holder as shown and described herein.

In another aspect, a magnetic instrument holder is used as shown and described herein.

In addition to the aforementioned aspects and features of the present invention, it should be noted that the present invention further encompasses the various possible combinations and subcombinations of such aspects and features. Thus, for example, any aspect may be combined with an aforementioned feature in accordance with the present invention without requiring any other aspect or feature.

BRIEF DESCRIPTION OF THE DRAWINGS

One or more preferred embodiments of the present invention now will be described in detail with reference to the accompanying drawings, wherein the same elements are referred to with the same reference numerals.

FIGS. 6 and 7 present additional, schematic drawings of a magnetic instrument holder in accordance with another embodiment of the present invention.

DETAILED DESCRIPTION

Figure 1:
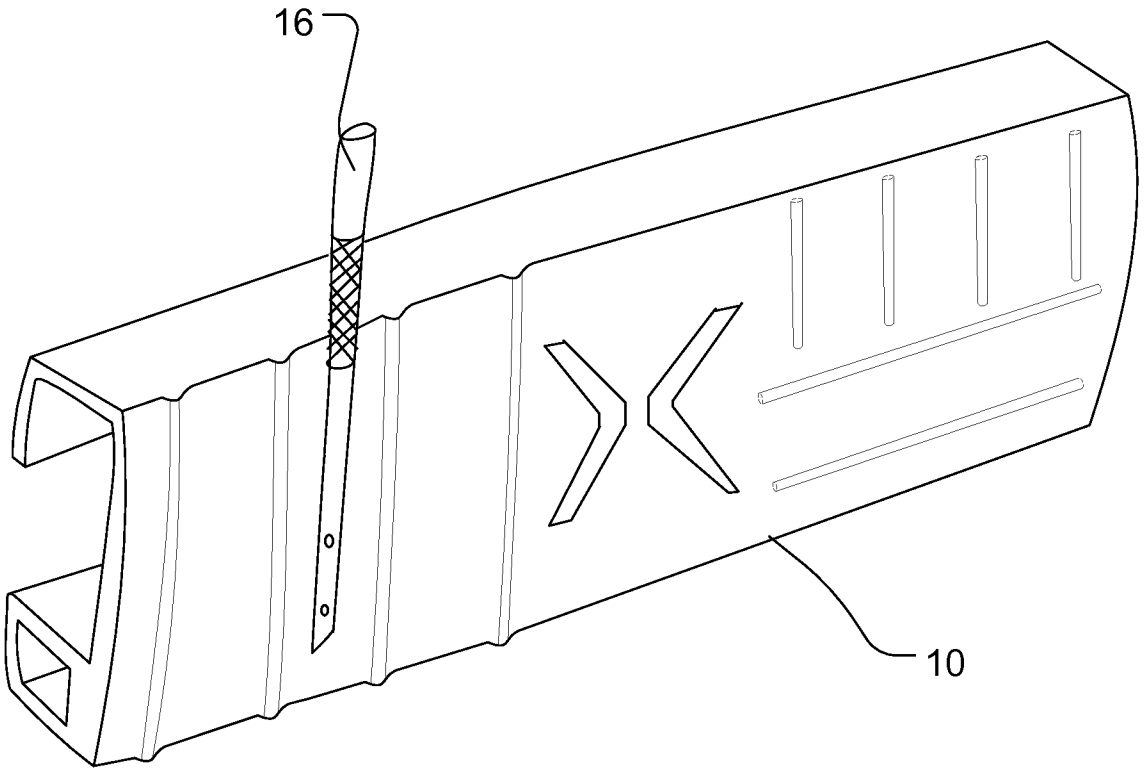
FIG. 1 is a perspective view of a magnetic instrument holder in accordance with an embodiment of the present invention.

As a preliminary matter, it will readily be understood by one having ordinary skill in the relevant art ("Ordinary Artisan") that the present invention has broad utility and application. As should be understood, any embodiment may incorporate only one or a plurality of the above-disclosed aspects of the invention and may further incorporate only one or a plurality of the above-disclosed features. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. As should be understood, any embodiment may incorporate only one or a plurality of the above-disclosed aspects of the invention and may further incorporate only one or a plurality of the above-disclosed features. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. §112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, one or more preferred embodiments of the present invention are next described. The following description of one or more preferred embodiments is merely exemplary in nature and is in no way intended to limit the invention, its implementations, or uses.

Turning now to FIG. 1, a magnetic instrument holder 10 in accordance with an embodiment of the present invention is shown.

Figure 2:
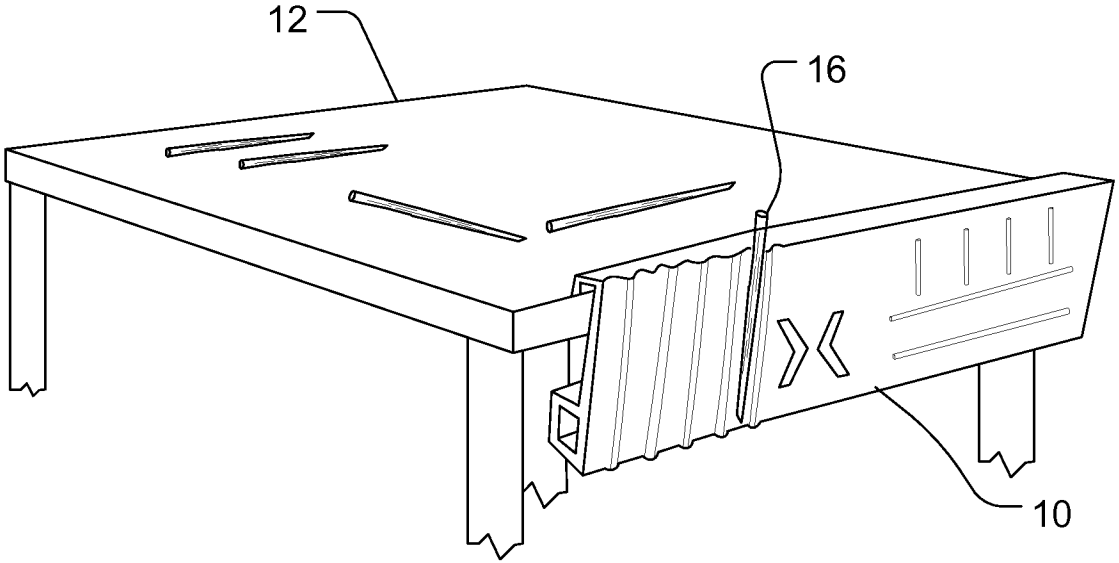
FIG. 2 is a perspective view of the magnetic instrument holder of FIG. 1, wherein the holder is shown attached to a surgical table.

FIG. 2 is a perspective view of the magnetic instrument holder 10 shown attached to a surgical table 12.

Figure 3:
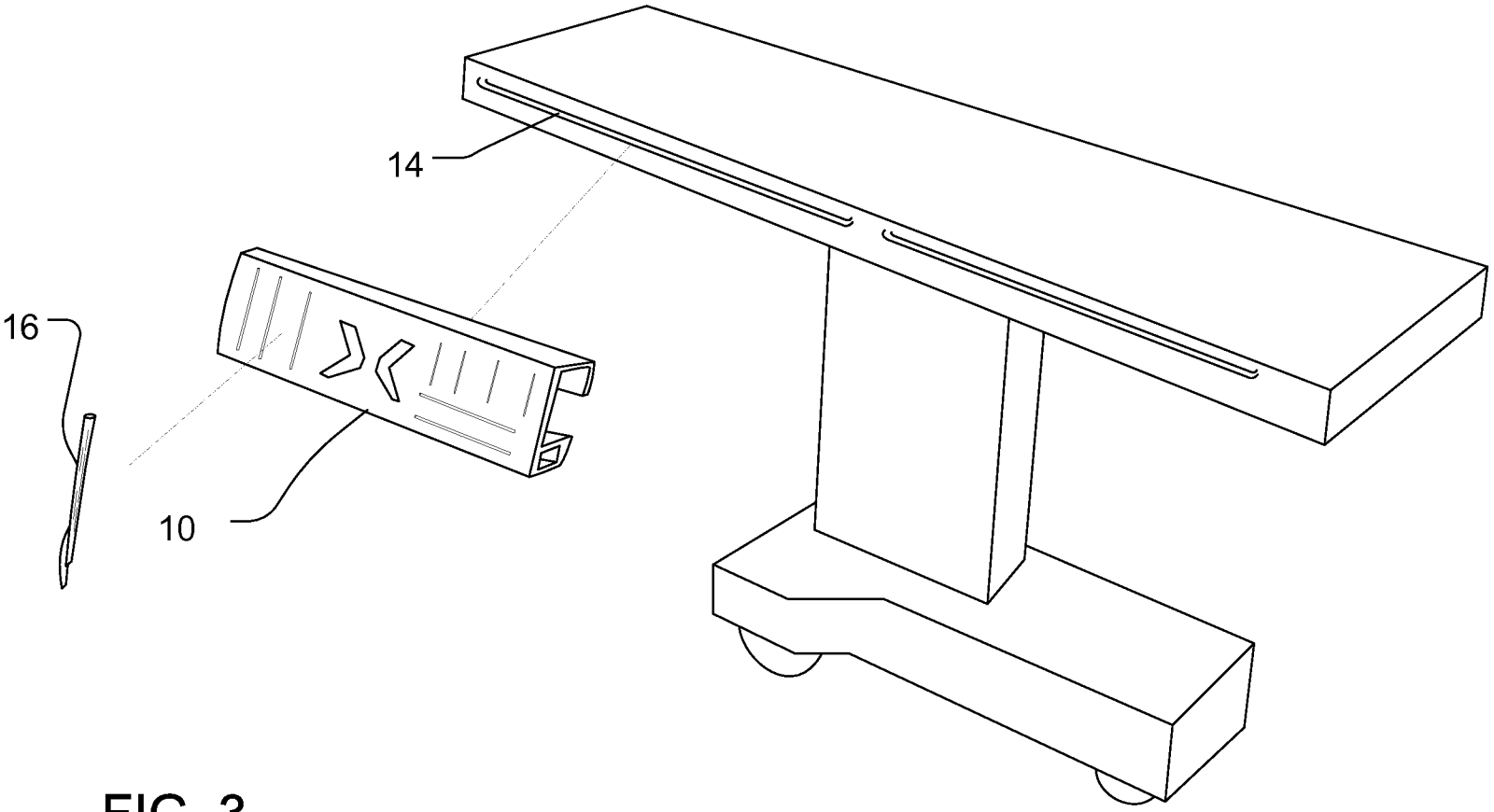
FIG. 3 is a perspective view illustrating the attachment of the magnetic instrument holder of FIG. 1 to a rail of a surgical table, and showing the attachment by magnetism of a metallic instrument to the holder.

FIG. 3 is a perspective view illustrating the attachment of the magnetic instrument holder 10 to a rail of a surgical table 14, and showing the attachment by magnetism of a metallic instrument 16 to the holder.

Figure 4:
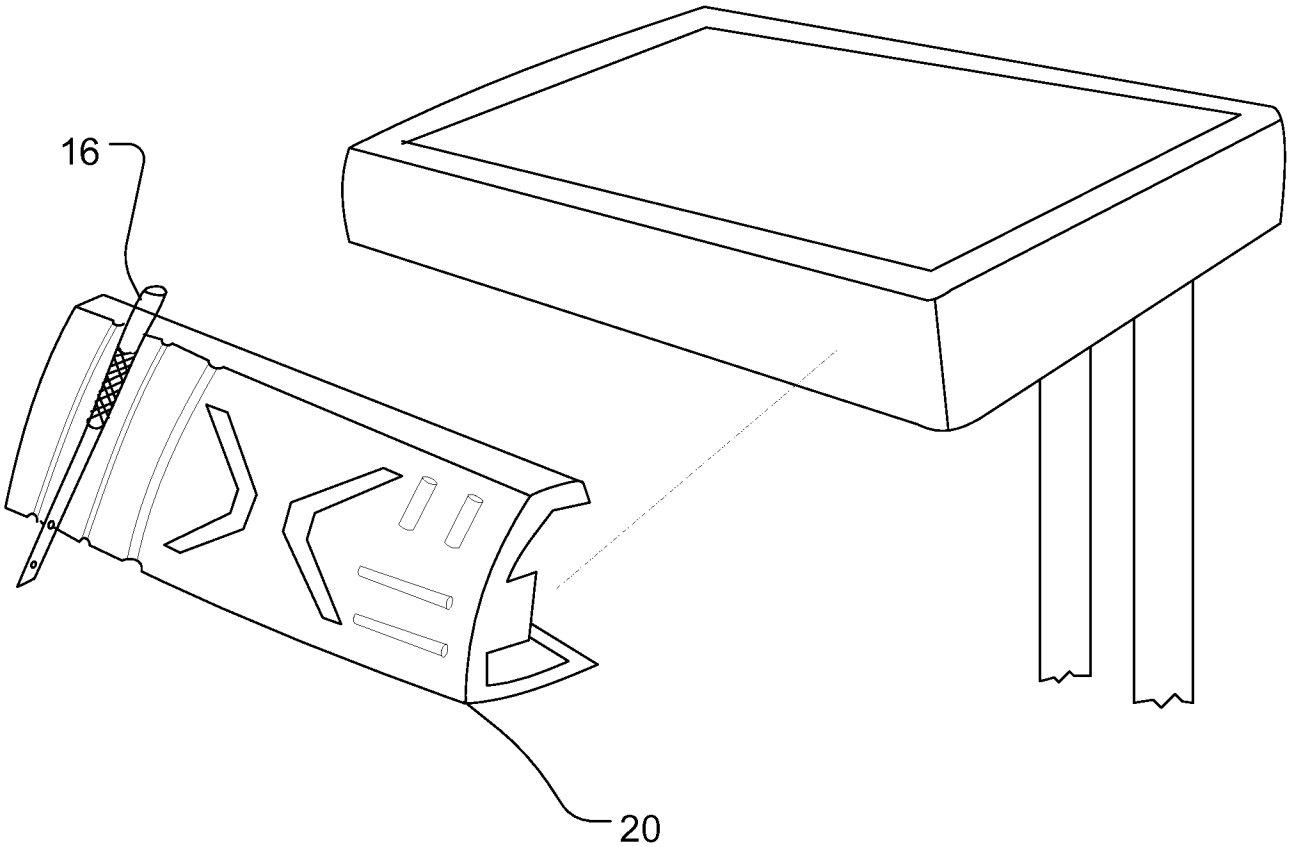
FIG. 4 is another perspective view illustrating attachment of a magnetic instrument holder in accordance with another embodiment of the present invention to another surgical table.

FIG. 4 is another perspective view illustrating attachment of another magnetic instrument holder 20 in accordance with another embodiment of the present invention to another surgical table.

Figure 5:
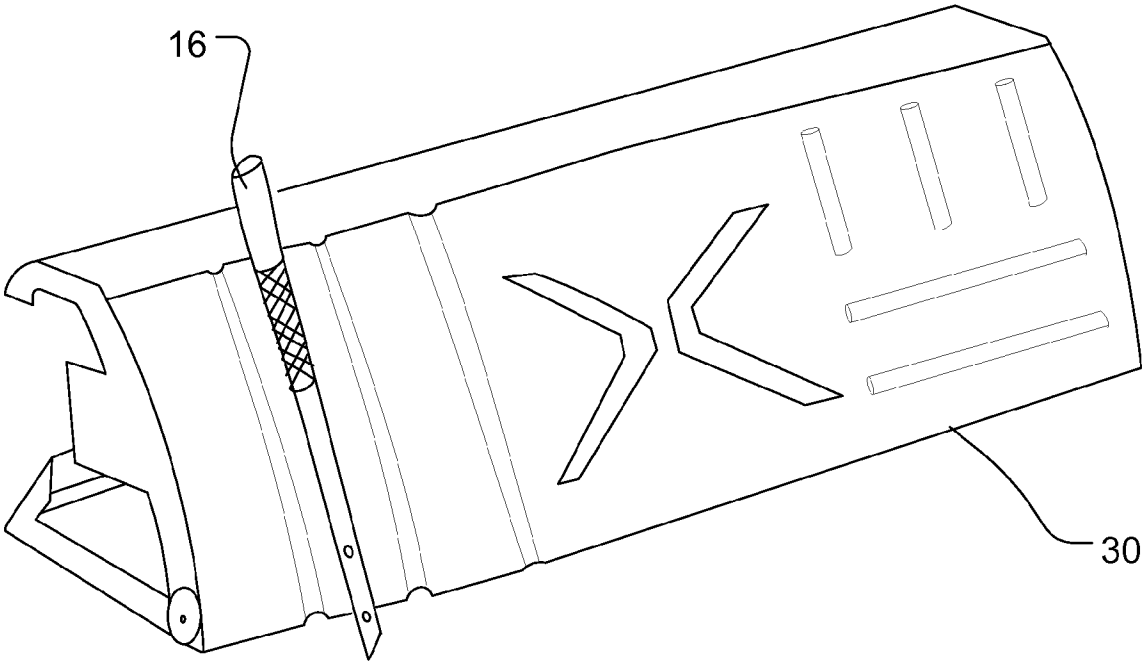
FIG. 5 is a perspective view of a magnetic instrument holder in accordance with another embodiment of the present invention.

FIG. 5 is a perspective view of a magnetic instrument holder 30 in accordance with another embodiment of the present invention.

Figure 6:
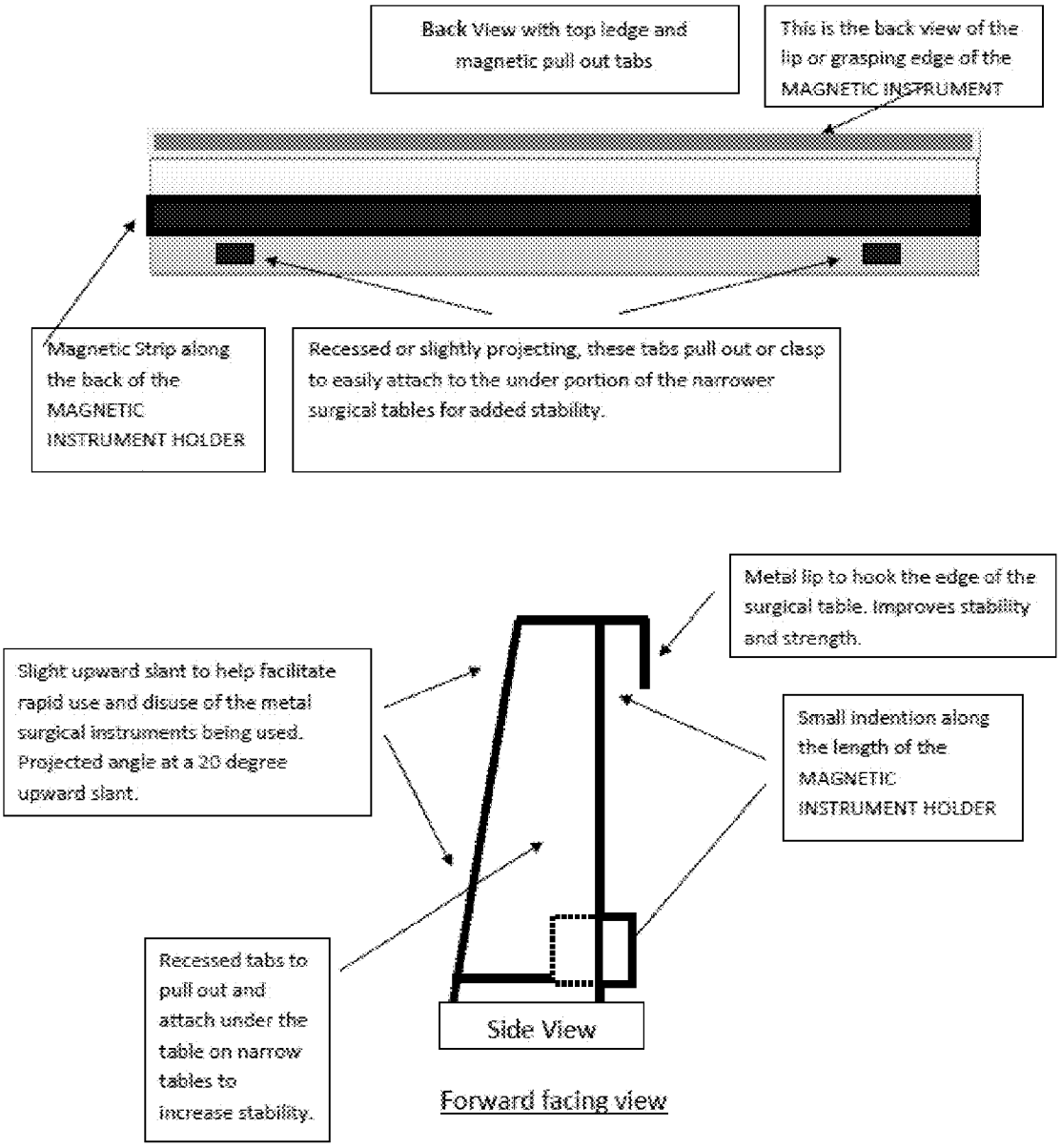

FIGS. 6 and 7 present additional, schematic drawings of a magnetic instrument holder in accordance with another embodiment of the present invention.

The magnetic instrument holds preferably includes groves facing the surgeon for receiving metallic instruments and powered equipment, such as high speed drills and the like. Larger grooves are provided on the surgeon's side for drills, and smaller groves are provided on the assistant's and surgical tech's side that can be used for multiple instruments and, preferably, long and slender instruments, such as Penfield instruments and the like.

In use, when an surgical table is set up in the operating room and the sterile drape is placed over the surgical table, the magnetic instrument holder can be attached to it. The process of utilizing the magnetic instrument holder calls for inserting the magnetic instrument holder into a sterile, plastic sleeve, accomplished using sterile technique. After magnetic instrument holder has been fully placed into the sleeve and covered properly, the magnetic instrument holder is attached to the long edge of the surgical table facing the surgeon and the surgical field. The magnetic instrument holder may attach to the surgical table in a press-fit manner. Alternatively, the magnetic instrument holder may have a backside configured such, when titled, the lip or edge around the surgical table—which is generally present on all surgical tables—is received within a recess of the magnetic instrument holder, whereupon the back portion of the magnetic bar magnetically secures itself to the metal table.

At the conclusion of the operation, the magnetic instrument holder is removed from the plastic sleeve, and the plastic sleeve is discarded. The magnetic instrument holder then may be re-used in subsequent cases without worry of the concomitant use of the plastic sleeve. By allowing for the device to organize and keep the instruments from falling on the floor, this will help with cost savings, loss prevention and maintaining the flow of the case.

It is contemplated that instructions will accompany commercial embodiments of the invention. Exemplary step-by-step instructions follow.

1) Once the surgical table has been sterilely draped, the magnetic instrument holder is obtained from a non-sterile staff member.
2) A sterile, plastic, form-fitted sleeve will be handed to the scrub tech.
3) The magnetic instrument holder is then inserted carefully into the sterile sleeve by both the circulator and surgical technologist. Insert the magnetic base using sterile technique.
4) Holding the magnetic instrument holder long wise, tilt the upper portion of the magnetic bar's metal lip over the long edge of the surgical table's edge.
5) Once the magnetic instrument holder is engaged over the lip of the surgical table, rest the bar firmly against the mayo table. If needed, fold up the bottom clasps on the underside of the magnetic bar under the surgical table to increase its stability. In this regard, some mayo or surgical tables do not have a high edge of metal that faces the surgeon; in this scenario, pull out the tabs on the back of the magnetic instrument holder pushing up onto the bottom of the surgical table increasing the stability in these cases.

6) The magnetic instrument holder is now ready to be used.

As will be appreciated from the disclosure herein, the magnetic instrument holder readily attaches to and detaches from various types of sterile surgical platforms. The surgical instruments also attaches and detaches very easily. This new innovation, although simple, carries with it many advantages, believed to include:

1) Improved use and disuse of multiple instruments by keeping the instruments "at the ready" for the surgeon and/or assistant.
2) Decreased cluttered wires and piles of instruments that commonly fall under the sterile table and usually end up on the floor, possibly resulting in breakage and additional re-sterilization and cost is generally needed when this occurs.
3) Improved safety of the instruments, such as the drill lying in a cluttered pile of wires and other instruments. A rapid grab can puncture the skin through the glove easily. By keeping these instruments organized decreases the probability of harm to the staff.
4) Prevention of dropped instruments and lost sterility. Replacing instruments and re-sterilizing instruments can be very costly. This device decreases this occurrence by keeping the instruments and devices safe and not allow for added cost, such as with additional sterilization and packaging.
5) Increased ease of use, in the respect that if the surgical technologist needs to work in another part of the table, he/she can stage instruments for the case maintaining the flow of the case.

In conclusion, the magnetic instrument holder simultaneously decreases loss and improves safety in each case. Sharp instruments, exposed drills, and the sheer clutter found in nearly every case, by dropping instruments not being used, is antiquated and unsafe. The use of the magnetic instrument holder with each case will make the case more proficient and improve the transfer of these vital instruments to the surgeon when they are needed and not needed. The bar keeps the instruments in a safe but reachable distance maximizing the organization of the case. Frustration will be less not having to constantly detangle wires, which when consistently done, can harm the electronics. Lastly, the bar is re-usable. The sterile plastic sleeve will be used for each case, which allows for its use in multiple surgeries Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

Indeed, while the magnetic instrument holder has been described as being reusable, it is contemplated within the scope of the invention that the magnetic instrument holder be disposable. In such instance, the magnetic instrument holder would be discarded after use in accordance with standard applicable HAZMAT procedures.

What is claimed is:

1. A magnetic instrument holder comprising:

(a) a front, generally planar instrument retaining face disposed on a first, front side of the magnetic instrument holder, the instrument retaining face comprising
  (i) a plurality of grooves sized and dimensioned for receiving metallic surgical instruments, and
  (ii) one more magnets positioned to effect retention of metallic instruments disposed in the plurality of grooves;

(b) a lip extending from a top of a second, back side of the magnetic instrument holder that is opposite the first, front side of the magnetic instrument holder, a back of the lip comprising one or more magnets such that the back face of the lip is magnetized and configured to magnetically adhere to a metal surgical table;

(c) a first adjustable tab extending from the second, back side of the magnetic instrument holder proximate a first lengthwise side of the magnetic instrument holder, the first adjustable tab comprising one or more magnets such that a portion of the first adjustable tab is magnetized and configured to magnetically adhere to a metal surgical table;

(d) a second adjustable tab extending from the second, back side of the magnetic instrument holder proximate a second lengthwise side of the magnetic instrument holder, the second adjustable tab comprising one or more magnets such that a portion of the first adjustable tab is magnetized and configured to magnetically adhere to a metal surgical table;

(e) wherein the first adjustable tab and the second adjustable tab are each configured to be adjusted between
  (i) a first, recessed position for use in attaching the magnetic instrument holder to a thicker surgical table where the tabs are not necessary for securement of the magnetic instrument holder, and
  (ii) a second, projecting position for use in attaching the magnetic instrument holder to a thinner surgical table such that the tabs facilitate securement of the magnetic instrument holder;

(f) wherein the front, generally planar instrument retaining face is oriented and positioned such that, when the magnetic instrument holder is secured to a surgical table, the generally planar instrument retaining face is oriented at an angle such that the generally planar instrument retaining face slopes downward such that a bottom edge of the generally planar instrument retaining face is disposed further from a surgical table the magnetic instrument holder is attached to than a top edge of the generally planar retaining face.

2. The magnetic instrument holder of claim 1, wherein the magnetic instrument holder is disposed within a sterile sleeve.

3. The magnetic instrument holder of claim 1, wherein some of the plurality of grooves positioned on one of the lengthwise sides of the magnetic instrument holder are smaller grooves configured for long and slender instruments.

4. The magnetic instrument holder of claim 3, wherein one or more of the some of the plurality of grooves are configured for Penfield instruments.

5. The magnetic instrument holder of claim 1, wherein some of the plurality of grooves positioned on one of the lengthwise sides of the magnetic instrument holder are larger grooves configured for drills.

6. The magnetic instrument holder of claim 1, wherein some of the plurality of grooves positioned on one of the lengthwise sides of the magnetic instrument holder are smaller grooves configured for long and slender instruments, and some of the plurality of grooves positioned on the other lengthwise sides of the magnetic instrument holder are larger grooves configured for drills.

7. The magnetic instrument holder of claim 1, wherein the front, generally planar instrument retaining face is oriented and positioned such that, when the magnetic instrument holder is secured to a surgical table, the generally planar instrument retaining face is oriented at a generally twenty degree angle.

8. A magnetic instrument holder comprising:

(a) a front, generally planar instrument retaining face disposed on a first, front side of the magnetic instrument holder, the instrument retaining face comprising
  (i) a plurality of grooves sized and dimensioned for receiving metallic surgical instruments, and
  (ii) one more magnets positioned to effect retention of metallic instruments disposed in the plurality of grooves;

(b) a lip extending from a top of a second, back side of the magnetic instrument holder that is opposite the first, front side of the magnetic instrument holder, a back of the lip comprising one or more magnets such that the back face of the lip is magnetized and configured to magnetically adhere to a metal surgical table;

(c) an adjustable member extending from the second, back side of the magnetic instrument holder, the adjustable member comprising one or more magnets such that a portion of the adjustable member is magnetized and configured to magnetically adhere to a metal surgical table, the adjustable member being configured to be adjusted between two or more positions for securement of the magnetic instrument holder to different surgical tables;

(d) wherein the front, generally planar instrument retaining face is oriented and positioned such that, when the magnetic instrument holder is secured to a surgical table, the generally planar instrument retaining face is oriented at an angle such that the generally planar instrument retaining face slopes downward such that a bottom edge of the generally planar instrument retaining face is disposed further from a surgical table the magnetic instrument holder is attached to than a top edge of the generally planar retaining face.

9. The magnetic instrument holder of claim 8, wherein the magnetic instrument holder is disposed within a sterile sleeve.

10. The magnetic instrument holder of claim 8, wherein some of the plurality of grooves positioned on one of the lengthwise sides of the magnetic instrument holder are smaller grooves configured for long and slender instruments.

11. The magnetic instrument holder of claim 10, wherein one or more of the some of the plurality of grooves are configured for Penfield instruments.

12. The magnetic instrument holder of claim 8, wherein some of the plurality of grooves positioned on one of the lengthwise sides of the magnetic instrument holder are larger grooves configured for drills.

13. The magnetic instrument holder of claim 8, wherein some of the plurality of grooves positioned on one of the lengthwise sides of the magnetic instrument holder are smaller grooves configured for long and slender instruments, and some of the plurality of grooves positioned on the other lengthwise sides of the magnetic instrument holder are larger grooves configured for drills.

14. A system comprising:

(I) a metal surgical table;

(II) a sterile sleeve;

(III) a magnetic instrument holder disposed within the sterile sleeve and secured to the metal surgical table, the magnetic instrument holder comprising:

(a) a front, generally planar instrument retaining face disposed on a first, front side of the magnetic instrument holder, the instrument retaining face comprising
  (i) a plurality of grooves sized and dimensioned for receiving metallic surgical instruments, and
  (ii) one more magnets positioned to effect retention of metallic instruments disposed in the plurality of grooves;

(b) a lip extending from a top of a second, back side of the magnetic instrument holder that is opposite the first, front side of the magnetic instrument holder, a back of the lip comprising one or more magnets such that the back face of the lip is magnetized and magnetically adhered to the metal surgical table;

(c) a first adjustable tab extending from the second, back side of the magnetic instrument holder proximate a first lengthwise side of the magnetic instrument holder, the first adjustable tab comprising one or more magnets such that a portion of the first adjustable tab is magnetized and magnetically adhered to the metal surgical table;

(d) a second adjustable tab extending from the second, back side of the magnetic instrument holder proximate a second lengthwise side of the magnetic instrument holder, the second adjustable tab comprising one or more magnets such that a portion of the first adjustable tab is magnetized and magnetically adhered to the metal surgical table;

(e) wherein the first adjustable tab and the second adjustable tab are each configured to be adjusted between
  (i) a first, recessed position for use in attaching the magnetic instrument holder to a thicker surgical table where the tabs are not necessary for securement of the magnetic instrument holder, and
  (ii) a second, projecting position for use in attaching the magnetic instrument holder to a thinner surgical table such that the tabs facilitate securement of the magnetic instrument holder;

(f) wherein the front, generally planar instrument retaining face is oriented at an angle such that the generally planar instrument retaining face slopes downward such that a bottom edge of the generally planar instrument retaining face is disposed further from the metal surgical table the magnetic instrument holder is attached to than a top edge of the generally planar retaining face; and (IV) a plurality of metallic surgical instruments received and retained within the plurality of grooves.

15. The system of claim 14, wherein the sleeve is form fitting.

16. The system of claim 14, wherein some of the plurality of grooves positioned on one of the lengthwise sides of the magnetic instrument holder are smaller grooves configured for long and slender instruments.

17. The system of claim 16, wherein one or more of the some of the plurality of grooves are configured for Penfield instruments.

18. The system of claim 14, wherein some of the plurality of grooves positioned on one of the lengthwise sides of the magnetic instrument holder are larger grooves configured for drills.

19. The system of claim 14, wherein some of the plurality of grooves positioned on one of the lengthwise sides of the magnetic instrument holder are smaller grooves configured for long and slender instruments, and some of the plurality of grooves positioned on the other lengthwise sides of the magnetic instrument holder are larger grooves configured for drills.

20. The system of claim 14, wherein one of the plurality of grooves is shaped to receive a mallet, and wherein one of the surgical tools comprises a mallet.

* * * * *